US008354567B2

(12) United States Patent
Leavitt et al.

(10) Patent No.: US 8,354,567 B2
(45) Date of Patent: Jan. 15, 2013

(54) DESTRUCTION OF MIXED RADIOACTIVE WASTE BY CATALYZED CHEMICAL OXIDATION

(76) Inventors: David Donald Leavitt, Edmond, OK (US); Robert Dale Delano, Edmond, OK (US)

( * ) Notice: Subject to any disclaimer, the term of this patent is extended or adjusted under 35 U.S.C. 154(b) by 1093 days.

(21) Appl. No.: 12/362,107

(22) Filed: Jan. 29, 2009

(65) Prior Publication Data

US 2012/0101324 A1 Apr. 26, 2012

Related U.S. Application Data

(60) Provisional application No. 61/024,824, filed on Jan. 30, 2008.

(51) Int. Cl.

| | |
|---|---|
| ***G21F 9/00*** | (2006.01) |
| ***A62D 3/30*** | (2007.01) |
| ***A62D 3/32*** | (2007.01) |
| ***A62D 3/33*** | (2007.01) |
| ***A62D 3/34*** | (2007.01) |
| ***A62D 3/35*** | (2007.01) |
| ***A62D 3/36*** | (2007.01) |
| ***A62D 3/37*** | (2007.01) |
| ***A62D 3/38*** | (2007.01) |

(52) U.S. Cl. ..... 588/20; 588/313; 588/314; 588/315; 588/316; 588/317; 588/318; 588/319; 588/320

(58) Field of Classification Search ..... None
See application file for complete search history.

(56) References Cited

U.S. PATENT DOCUMENTS

| | | | |
|---|---|---|---|
| 3,673,086 | A | 6/1972 | Drobnik |
| T970007 | I4 | 5/1978 | McCullough et al. |
| 4,180,545 | A | 12/1979 | McCullough et al. |

(Continued)

FOREIGN PATENT DOCUMENTS

| | | |
|---|---|---|
| CA | 955033 | 9/1974 |

(Continued)

OTHER PUBLICATIONS

International Search Report issued in application No. PCT/US2009/000565 on Oct. 21, 2009.

(Continued)

*Primary Examiner* — Stanley Silverman
*Assistant Examiner* — Jennifer Smith
(74) *Attorney, Agent, or Firm* — Foley & Lardner LLP

(57) ABSTRACT

Described are method of treating a radioactive organic waste stream comprising:

(a) mixing a radioactive organic waste stream comprising organic compounds and radionuclides with phosphoric acid to form a reaction mixture;

(b) heating the reaction mixture to a desired temperature in the presence of an oxidant to oxidize organic compounds present in the waste stream, and removing oxidized organic compounds from the reaction mixture;

(c) optionally, adding a reducing agent to the reaction mixture to form insoluble radioactive metal phosphate compounds comprising one or more of the radionuclides, and separating the insoluble radioactive metal phosphate compounds from the reaction mixture;

(d) optionally, adding a fluorine compound to the reaction mixture to react with uranium that may be present in the reaction mixture to form uranium hexafluoride, and removing uranium hexafluoride from the reaction mixture;

(e) adding ammonia to the reaction mixture to neutralize phosphoric acid and to form ammonium phosphate complexes comprising one or more of the radionuclides, and separating the ammonium phosphate complexes from the reaction mixture to yield an ammonium phosphate liquor, wherein the method includes performing at least one of steps (c) and (d).

19 Claims, 4 Drawing Sheets

U.S. PATENT DOCUMENTS

| | | | | |
|---|---|---|---|---|
| 4,217,192 | A | 8/1980 | Lerch et al. | |
| 4,399,110 | A | 8/1983 | Kurandt | |
| 4,407,781 | A | 10/1983 | Crossley et al. | |
| 4,450,142 | A | 5/1984 | Weterings et al. | |
| 4,514,365 | A | 4/1985 | Weterings et al. | |
| 4,756,853 | A | 7/1988 | Wieczorek et al. | |
| 4,808,391 | A * | 2/1989 | Leavitt et al. | 423/321.1 |
| 4,816,241 | A | 3/1989 | Bierman et al. | |
| 4,874,485 | A | 10/1989 | Steele | |
| 4,902,351 | A | 2/1990 | Kunze et al. | |
| 5,322,644 | A | 6/1994 | Dunn et al. | |
| 5,641,408 | A * | 6/1997 | Delloye et al. | 210/717 |
| 6,911,191 | B2 | 6/2005 | Neuman et al. | |

FOREIGN PATENT DOCUMENTS

| | | |
|---|---|---|
| EP | 0 618 592 | 10/1994 |
| FR | 2 724 164 | 3/1996 |

OTHER PUBLICATIONS

Moldenhawer, "Contamination and Decontamination of Surfaces," Nuclear Energy, vol. 5, pp. 585-600, 1962.

Leavitt et al., "Acid-Catalyzed Oxidation of 2,4-Dichlorophenoxyacetic Acid by Ammonium Nitrate in Aqueous Solution," vol. 24, No. 4, pp. 566-571, 1990.

Leavitt et al., "Homogeneously Catalyzed Oxidation for the Destruction of Aqueous Organic Wastes," Environmental Progress, vol. 9, No. 4, pp. 222-228, Nov. 1990.

Oji et al., "Loading Capacities for Uranium, Plutonium, and Neptunium in High Caustic Nuclear Waste Storage Tanks Containing Selected Sorbents," U.S. Department of Energy, report prepared in conjunction with contract No. DE-AC09-96SR18500, 2004.

* cited by examiner

SCHEMATIC OF EXPERIMENTAL APPARATUS

DESTRUCTION OF MIXED RADIOACTIVE WASTE BY CATALYZED CHEMICAL OXIDATION

CROSS-REFERENCE TO RELATED PATENT APPLICATIONS

This application claims priority to U.S. Provisional Application 61/024,824, filed Jan. 30, 2008, the entire contents of which are incorporated herein by reference.

FIELD OF THE INVENTION

The invention provides methods of treating mixed radioactive waste, including radioactive organic waste.

BACKGROUND

Rapidly changing technology and the continual development of new chemical processes and alternative technologies for the production of fuel and electricity have brought about an increase in the generation of hazardous wastes. Heightened environmental concern has led to regulation of the disposal of these materials, demanding recycling and reuse or, as an alternative, detoxification or destruction of these materials rather than long-term storage in landfills or lagoons. Of particular concern to society are the problems associated with radioactive materials generated by military and industrial processes and their applications, and much of this material is in the form of radioactive organic waste. Organic waste also forms a significant part of the radioactive waste produced at many nuclear facilities, including power reactors, nuclear fuel cycle facilities, research centers and medical facilities.

Treatment and Conditioning Processes for Organic Waste

The aim of applying treatment and conditioning techniques is to obtain a waste product that can be stored or disposed of more safely. The techniques for the treatment and conditioning of organic waste can be non-destructive or destructive, where the processes chemically alter or destructively modify the organic nature of the waste. For example, non-destructive techniques primarily involve a physical change in the properties of the material to enhance additional treatment, storage or disposal, but do not destroy the organic components (e.g. absorption, compaction, immobilization). Destructive techniques, on the other hand, primarily involve a chemical change in the waste product (e.g. incineration, pyrolysis).

Pyrolysis is based on thermal decomposition of organic compounds under an inert or oxygen deficient atmosphere to destroy the waste and convert it into an inorganic residue. Whereas incineration is utilized for low-level waste, pyrolysis is more often applied to intermediate level waste. The gas generated during pyrolysis is burned in a simple combustion chamber and then treated in a flue gas cleaning section. Temperatures for pyrolyzing organic waste are in the range of 500-550° C., significantly lower than the temperature for conventional incineration.

Direct chemical oxidation is another method for treating organic waste. Direct chemical oxidation involves the use of sodium or ammonium peroxydisulphate, a strong oxidant for decomposing organic waste. The operating temperature is normally 80-95° C. and the final bisulphate ion is recycled to produce new oxidant by conventional electrolysis. The organic compounds are converted to carbon dioxide and the inorganic residue products can be collected for immobilization in cement.

A review of the patent literature reveals several chemical processes that employ oxidizing agents and reducing agents in the treatment of radioactive waste. For example, U.S. Pat. No. 4,874,485 describes an electrochemical oxidation method for treating radioactive waste whereby Ag(II) ions are the primary oxidizing species in an aqueous nitric acid. U.S. Pat. No. 3,673,086 describes a method whereby nitric acid, nitrate ions and nitrite ions are removed from aqueous radioactive waste solutions by treating such solutions with boiling formic acid. This process is not useful for the direct oxidation of organic radioactive wastes. In U.S. Pat. No. 4,756,853, nitric acid is used to solubilize actinide ions contained in radioactive solid waste. The resulting solution is separated from the insoluble constituents of the residue and heated to a temperature about 40 C below the boiling point of the solution. Barium nitrate is added to the solution which is then allowed to age for several hours followed by cooling to room temperature. This results is the formation of a sulfate free actinide-nitrate solution.

Other studies describe the use of chemical oxidation to recover uranium from wet process phosphoric acid. Uranium is typically found in wet-process phosphoric acid. The uranium in the phosphoric acid is derived from that contained in the phosphate rock used as the raw material. The uranium content in domestic phosphate rock ranges from a low of 12 mg/Kg of rock to as high as 399 mg/Kg of rock. See, e.g., Menzel, *J. Agric. Food Chem.* 16 (2), 231 (1968). The uranium concentration in the phosphate ore bodies now actively mined is about 125 mg/Kg. When phosphate rock is converted to wet-process phosphoric acid by sulfuric acid acidulation, much of the valuable uranium in the rock passes into the phosphoric acid. Although the initial oxidation state of the uranium is variable, air oxidation may convert some of the uranium (IV) to uranium (VI), the uranyl form. The initial acid product produced by the wet-process method contains about 32 percent $P_2O_5$ and is known as filter-grade acid. The uranium concentration in the filter-grade acid generally lies in the range of 0.1 to 0.2 g/l. See, e.g., Hurst & Crouse, *J., Ind. Eng. Chem. Process Des, Develop.* 13 (3), 286-291 (1974).

In U.S. Pat. No. 4,180,545, wet process phosphoric acid is treated with a mixture of an ammonium salt or ammonia, a reducing agent, and then a miscible solvent in order to recover uranium from the acid. Specifically, wet-process phosphoric acid is mixed with an ammonium salt, typically ammonium bicarbonate, or ammonia, or both, while maintaining the temperature of the reaction mixture between about 20° C. to about 100° C. for a period of time necessary to dissolve the ammonium salt, ammonia, or both. A reducing agent is also added to the mixture, containing about 0.05 to about 0.20 moles of ammonium salt or ammonia, or both, for each mole of orthophosphoric acid present in the mixture. Additionally, one gram equivalent weight of reducing agent is used for each gram atom of iron present in said wet-process acid. Solids consisting of a mixture of metal phosphates and uranium are then separated from the phosphoric acid liquid phase. This process also employs a reducing agent that is added to the phosphoric acid to reduce the uranium compounds from the hexavalent to the tetravalent state. The reducing agent is added after the precipitant, because it results in the formation of a smaller amount of precipitate containing virtually all of the uranium. Among the reducing agents that can be used are, for example, powdered metallic iron, zinc and aluminum. The amount of reducing agent is not critical, but the quantity used must be sufficient to reduce all of the uranium to the tetravalent state.

A related process is disclosed in U.S. Defensive Publication No. T 970,007, where the organic dispersant is a water miscible organic solvent, such as methanol, ethanol, and/or isopropanol, and the precipitant is ammonia or an ammonium salt. The uranium is recovered by a known method from the uranium containing precipitate that is formed. The solvent used, e.g., methanol, is recovered by distillation and rectification, and is recycled.

Another related process is disclosed in U.S. Pat. No. 4,399,110, that describes a process in which the level of radioactivity in gypsum produced from phosphate rock can be reduced by adding to the slurry of acid and phosphate rock produced during the conventional process for making phosphoric acid, a combination of concentrated nitric acid or hydrochloric acid and an ammonium salt, especially ammonium nitrate or ammonium phosphate, before the precipitation of the calcium sulfate.

Yet another related patent, U.S. Pat. No. 4,450,142, describes a process for recovering a uranium-containing concentrate from wet-process phosphoric acid whereby the acid is treated with an aliphatic ketone and an inorganic fluoride compound in the presence of a reducing agent consisting of powdered metallic iron, zinc or aluminum.

Alternative reducing agents are disclosed in U.S. Pat. No. 4,816,241, such as a pressurized reducing gas, preferably hydrogen, used to reduce the valence state of ferrous and other ions present in phosphoric acid. The pressurized gas reduces the ions without an addition of metallic iron or other impurity. This process is used for recovering uranium from wet process phosphoric acid, wherein ferric or uranyl ions in the phosphoric acid are reduced using a pressurized reducing gas.

In U.S. Pat. No. 4,407,781, ammonium ions are used to facilitate the precipitation of actinide compounds from aqueous solutions. Here, the pH of the solution is first lowered using an inorganic acid such as hydrochloric acid to a pH from about 1 to about 4, and carbon dioxide is then removed from the solution by aeration. The subsequent increase in solution pH to about 9 in the presence of ammonium ions result in the precipitation of ammonium diuranate. The precipitated ammonium diuranate may then be filtered or otherwise separated from the solution.

Strong chemical oxidants are also used as decontaminating agents to recover radioactive materials from solid surfaces. U.S. Pat. No. 6,231,683 describes a method whereby radioactively contaminated material is cleaned by contacting the material with a decontaminating liquid comprising an aqueous solution of nitric acid containing an NOx generating agent. The NOx generating agent may be a nitrite, for example, sodium nitrite, or a ferrous metal. U.S. Pat. No. 4,217,192 describes a chemical etching process for reclaiming contaminated equipment wherein a reduction-oxidation system is included in a solution of nitric acid to contact the metal to be decontaminated. U.S. Pat. No. 4,690,782 describes a process consisting of successively bringing the surface of the contaminated materials into contact with a solution of sodium carbonate followed by contacting the surface of the contaminated materials with a solution of dilute nitric acid, to which potassium permanganate is being added, then bringing the contaminated materials into contact with a solution of oxalic acid and finally rinsing and drying the materials. U.S. Pat. No. 4,902,351 describes a method for decontaminating radioactively contaminated surfaces of metallic materials with the use of nitric acid and hydrofluoric acid. The surfaces to be decontaminated are subjected to a gaseous mixture of water vapor, hydrogen fluoride and nitric acid. U.S. Pat. No. 5,322,644 describes a process for decontaminating radioactive material by contacting the material with a dissolving composition to dissolve the contaminants in the material. The dissolving composition comprises a dilute solution of about 0.05 molar ethylene diamine tetraacetic acid, about 0.1 molar carbonate, about 10 grams per liter hydrogen peroxide and an effective amount of sodium hydroxide to adjust the pH of the composition from about 9 to a pH of about 11.

A summary report by. Moldenhawer entitled "Kontamination and Dekontamination von Oberflachen," in translation, "Contamination and Decontamination of Surfaces," *Nuclear Energy,* 5: 585 (1962), describes a number of different decontamination methods and a number of decontamination agents. The large majority of the listed decontamination agents are used in the form of aqueous solutions. Moldenhawer points out that strong inorganic acids are most effective, but also the most aggressive decontamination agents. Nitric acid or $HNO_3$ containing solutions are listed as being the most effective decontaminants. Moldenhawer states, however, that it is wrong to draw the conclusion that pure nitric acid would be the best decontamination agent.

SUMMARY

In accordance with some embodiments, there is provided methods of treating a radioactive organic waste stream comprising: (a) mixing a radioactive organic waste stream comprising organic compounds and radionuclides with phosphoric acid to form a reaction mixture; (b) heating the reaction mixture to a desired temperature in the presence of an oxidant to oxidize organic compounds present in the waste stream, and removing oxidized organic compounds from the reaction mixture; (c) optionally, adding a reducing agent to the reaction mixture to form insoluble radioactive metal phosphate compounds comprising one or more of the radionuclides, and separating the insoluble radioactive metal phosphate compounds from the reaction mixture; (d) optionally, adding a fluorine compound to the reaction mixture to react with uranium that may be present in the reaction mixture to form uranium hexafluoride, and removing uranium hexafluoride from the reaction mixture; (e) adding ammonia to the reaction mixture to neutralize phosphoric acid and to form ammonium phosphate complexes comprising one or more of the radionuclides, and separating the ammonium phosphate complexes from the reaction mixture to yield an ammonium phosphate liquor. In some embodiments, the method includes performing at least one of steps (c) and (d). The method may be carried out in a batch mode or in a continuous mode.

In some embodiments, the radioactive organic waste stream comprises one or more radionuclides selected from the group consisting of plutonium, uranium, neptunium. In some embodiments, the phosphoric acid is superphosphoric acid (SPA). In some embodiments, the oxidant is added to the reaction mixture, and may be selected from the group consisting of nitric acid; ammonium nitrate; iodate; chromate; permanganate; peroxide; oxygen; ozone; persulfate; sodium chlorate sodium perchlorate; sodium peroxydisulphate; ammonium peroxydisulphate; air; iodate; peroxide; chromate; permanganate; peroxydisulphate; chlorate; and perchlorate. In some embodiments, in step (b), the reaction mixture is heated by an external source, while in other embodiments the reaction mixture is heated by an exothermic reaction between compounds present in the radioactive organic waste stream. In some embodiments, the reducing agent is selected from the group consisting of iron, zinc aluminum, ammonia, formic acid, hydrazine and hydrogen gas. In some embodiments, the fluorine compound is selected from the group consisting of hydrofluoric acid, sodium fluoride and $H_2SiF_6$.

In some embodiments, the method further comprises, prior to step (b), (a') heating the reaction mixture to a temperature greater than 350° F. under reducing conditions in the absence of the oxidant to volatilize volatile organic compounds and/or pyrolize stable organic compounds that may present in the reaction mixture, and removing volatilized organic compounds from the reaction mixture as an off-gas.

In some embodiments, the method further comprises, after step (b): (b') adding water to the reaction mixture to hydrolyze polyphosphate that may be present in the mixture; wherein, in step (b'), water is added in an amount sufficient to achieve a phosphoric acid concentration in the reaction mixture of about 54% to 60% by weight.

In some embodiments, the method further comprises, after step (c): (c') aging the reaction mixture to facilitate the formation of insoluble radioactive metal phosphate compounds.

In some embodiments, the separating step of step (c) is repeated at different time periods to separate insoluble radioactive metal phosphate compounds comprising different radionuclides at different time periods.

DETAILED DESCRIPTION

Figure 1:
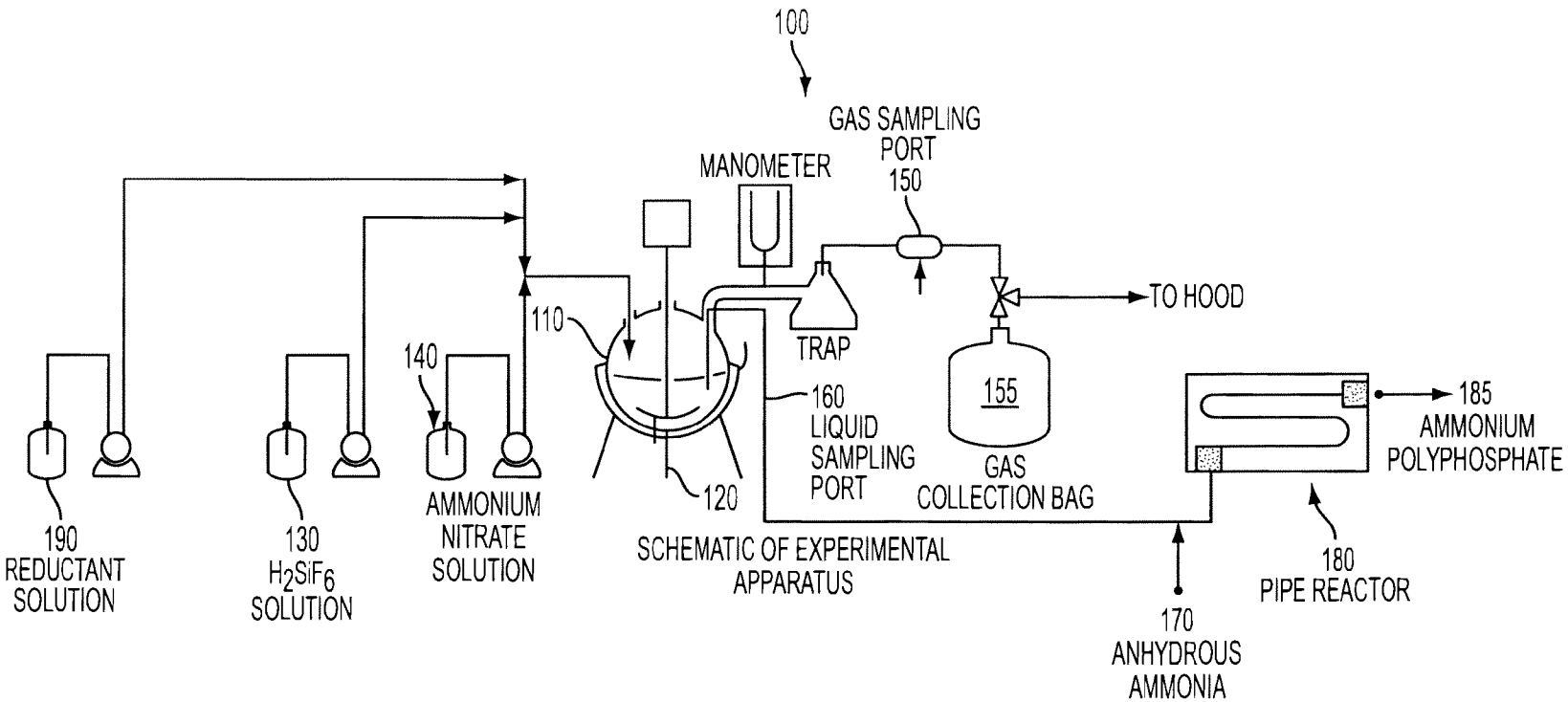
FIG. 1 provides a schematic flow chart of a batch process used to treat mixed organic radioactive waste in accordance with the methods described herein.

The references cited herein, including patents and patent applications, are incorporated by reference, in their entirety.

Technical and scientific terms used herein have the meanings commonly understood by one of ordinary skill in the art to which the present invention pertains, unless otherwise defined. Reference is made herein to various methodologies known to those of ordinary skill in the art. Publications and other materials setting forth such known methodologies to which reference is made are incorporated herein by reference in their entireties as though set forth in full. Materials, reagents and the like to which reference is made in the following description and examples are obtainable from commercial sources, unless otherwise noted.

As used herein, the singular forms "a," "an," and "the" designate both the singular and the plural, unless expressly stated to designate the singular only.

As used herein, "about" will be understood by persons of ordinary skill in the art and will vary to some extent on the context in which it is used. If there are uses of the term which are not clear to persons of ordinary skill in the art given the context in which it is used, "about" will mean up to plus or minus 10% of the particular term.

It should be understood that all reaction conditions, reactant conditions, product conditions, etc. (including but not limited to temperature, pH, concentration, and EMF) described herein are provided for guidance only, and it is not necessary to measure or determine the described conditions in order to practice the methods described herein.

As outlined above, a wide variety of treatment and conditioning techniques are available for the treatment of radioactive organic waste. Selection of the most appropriate treatment/conditioning methods for a given waste is often a complex process. Often the selection of a treatment/conditioning method will depend on the nature of the waste and the hazardous components that are present therein. Described herein are novel methods for treating mixed radioactive waste, including radioactive organic waste. The organic nature of radioactive organic waste may introduce hazards that are not encountered with inorganic waste, such as susceptibility to radiolysis and biodegradation, flammability, volatility, chemical toxicity and inherent biological hazards.

Described herein are methods for the destruction and detoxification of radioactive organic waste using, for example, catalyzed chemical oxidation and reduction in phosphoric acid. The methods are more economical and environmentally friendly than prior methods currently in use and permit recovery of actinides and other radioactive materials. In specific embodiments, the methods involves controlled, sequential reduction and catalyzed oxidation and acid hydrolysis steps that convert the organic compounds in the mixed waste into, for example, non-toxic gases, while facilitating the recovery of actinides and other radionuclides in the form of, for example, phosphate complexes.

Types of Radioactive Organic Waste

The methods described herein are useful for treating any type of radioactive organic waste. The following examples of specific types of radioactive organic waste are exemplary only. In specific embodiments, the radioactive organic waste comprises one or more radionuclides selected from the group consisting of plutonium, uranium, and neptunium, or may include red oil, which is an explosive and unstable mixture of solvent, nitric acid and radionuclides.

Radioactive organic waste may be in liquid, solid, or gaseous form. Liquid organic waste (LOW) poses significant hazards due its volatility, flammability, toxicity, and chemical instability. Often, LOW is converted to a less hazardous form, thus allowing its continued storage without production of a final waste form for disposal. This may be particularly attractive in cases where a disposal facility is not yet available or where relevant waste acceptance criteria (WAC) have not been determined. The conversion may yield a less hazardous organic species or result in an inorganic form.

Solid waste can be produced by solidification of LOW. Solidification may be achieved in various ways. The most common method involves absorption into a porous solid material or mixing the LOW with a material that subsequently sets to form a solid mass. The conversion of a liquid to solid form may be temporary or permanent. Storing radioactive waste as a solid also has many advantages. For example, it allows for ease of transport of the waste, as the mobility of the waste is controlled and is not dependent on active containment, increasing the flash point of the waste and stabilization of the radioactive waste.

A wide variety of organic liquids are used in the nuclear industry. These can be broadly categorized as lubricants, solvents (including organic solvents such as ethers or tributyl phosphate (TBP) and its diluents such as dodecane or mixtures of paraffins, and chlorinated or fluorinated hydrocarbons), process fluids and diluents, scintillation liquids (including toluene and xylene) and decontaminants (including organic phase liquids and aqueous solutions). Typically, organic liquids comprise a low proportion of the total organic component in waste. However, aqueous waste with a significant organic content, including soluble organic decontamination agents, is also considered as liquid organic waste, or is characterized as wastewater with a high chemical or biological oxygen demand (COD/BOD).

In some embodiments, the components of the mixed radioactive organic waste to be treated are determined, to facilitate selection of the most appropriate treatment method. For example, it can be advantageous to identify the components to avoid potentially harmful and violent chemical interactions between components and treatment reagents. Moreover, identifying the radionuclides that may be present can facilitate selection of the most appropriate and effective processing steps, as discussed below.

Catalyzed Chemical Oxidation

In specific embodiments, the methods described herein use catalyzed chemical oxidation. Catalyzed chemical oxidation offers the potential for selectively converting undesired organic compounds in a mixed waste stream to $CO_2$ and water, while converting any radioactive compounds to reusable materials. Catalyzed chemical oxidation can be carried out at temperatures between 250-700° F. and atmospheric pressure, and low levels of radioactive compounds can be entrapped in the gases that are emitted during catalytic oxidation processes. In contrast, processes such as incineration require the use of high temperatures (up to 2000° F.), while treatment methods such as wet-air oxidation requires the application of pressure up to 5,000 psi.

A catalyzed oxidative process has been used to treat waste effluent devoid of radioactive compounds. See, e.g., Leavitt & Abraham, *Environ. Sci. Technol.* 24(4) 566 (1990); Leavitt et al., *Environ. Prog.* 9(4) 222 (1990). The oxidative treatment of waste containing organic species, such as atrazine, 2,4-dichlorophenozyacetic acid, and biphenyl, resulted in their conversion to $CO_2$ and other non-harmful gases via an acid catalyzed oxidation process. Nearly complete conversion was obtained through homogeneous liquid-phase oxidation using ammonium nitrate as the oxidant. The addition of small amounts of transition metal salts to the reaction mixture increased conversion of waste organics to carbon dioxide and other non-harmful gases to quantitative levels (greater than 99%).

In the context of the present invention, catalyzed chemical oxidation offers advantages of being a low risk treatment option that offers the potential for selectively converting undesirable organic compounds in a mixed stream containing radioactive impurities into reusable materials. In some embodiments, the end product of the oxidative waste treatment is the complete conversion of organics to carbon dioxide ($CO_2$) and water and the entrapment of relatively low levels of radioactive compounds in the gases that are emitted during catalytic oxidation processes. The methods described herein therefore provide a less harmful and environmentally friendly option for treating radioactive organic waste and also provide the potential for the recovery and reuse of waste materials. Moreover, the ability to use processing temperatures of between about 250-700° F. and low pressure (such as atmospheric pressure) is advantageous as compared to processes such as incineration, which require the use of high temperatures (up to 2000° F.), or wet-air oxidation, which requires the application of pressure up to 5,000 psi. In addition, the use of inorganic acids may speed up the degradation and hydrolysis of organic waste into less toxic compounds, and inorganic acids such as phosphoric acid provide solvent stability under most reaction conditions and may interact with metals present in the waste stream to produce additional catalyst in situ. The presence of a selective oxidant such as ammonium nitrate, which can be solubilized in the acid, may further accelerate the rate of reaction. Thus, the methods described herein offer many advantages.

The methods described herein may include one or more of the following steps:

(a) mixing a radioactive organic waste stream (comprising organic compounds and radionuclides) with phosphoric acid to form a reaction mixture;

(b) heating the reaction mixture to a desired temperature in the presence of an oxidant to oxidize organic compounds present in the waste stream, and removing oxidized organic compounds from the reaction mixture;

(c) optionally, adding a reducing agent to the reaction mixture to form insoluble radioactive metal phosphate compounds comprising one or more of the radionuclides, and separating the insoluble radioactive metal phosphate compounds from the reaction mixture;

(d) optionally, adding a fluorine compound to the reaction mixture to react with uranium that may be present in the reaction mixture to form uranium hexafluoride, and removing uranium hexafluoride from the reaction mixture;

(e) adding ammonia to the reaction mixture to neutralize phosphoric acid and to form ammonium phosphate complexes comprising one or more of the radionuclides, and separating the ammonium phosphate complexes from the reaction mixture to yield an ammonium phosphate liquor.

In some embodiments, the method further comprises, prior to step (b), (a') heating the reaction mixture to a temperature greater than 350° F. under reducing conditions in the absence of the oxidant to volatilize volatile organic compounds and/or pyrolize stable organic compounds that may present in the reaction mixture, and removing volatilized organic compounds from the reaction mixture as an off-gas.

In some embodiments, the method further comprises, after step (b), (b') adding water to the reaction mixture to hydrolyze polyphosphate that may be present in the mixture, wherein the water is added in an amount sufficient to achieve a phosphoric acid concentration in the reaction mixture of about 54% to 60% by weight.

In some embodiments, the method further comprises, after step (c), (c') aging the reaction mixture to facilitate the formation of insoluble radioactive metal phosphate compounds.

In some embodiments, the separating step of step (c) is repeated at different time periods to separate insoluble radioactive metal phosphate compounds comprising different radionuclides at different time periods.

In some embodiments, the separating step of step (e) is repeated at different time periods to separate different ammonium phosphate complexes at different time periods.

In some embodiments, the method further comprises, after step (e), further purifying the ammonium phosphate complexes. Additionally or alternatively, the ammonium polyphosphate liquor may be converted into liquid fertilizer.

In typical embodiments, the methods include performing steps (a), (b), at least one of steps (c) and (d), and step (e). The methods also may include any combination of one or more of stapes (a'), (b') and/or (c'), and/or a further purification step after step (e). The invention is not limited to a particular order of steps, although the steps will typically be performed in alphabetical order (e.g., one or more of (a) then (a') then (b) then (b') then (c) then (c') then (d) then (e)).

The method may be carried out in any fashion, including in a sequential batch mode or in a continuous mode.

Thus, in some embodiments, a radioactive organic waste stream is mixed with phosphoric acid and heated to the desired temperature in the presence of an oxidant. This may completely oxidize the organic compounds or convert them to valuable intermediates that will evaporate from the hot reaction mixture and thus can be separated from the radioactive compounds remaining in the mixture, such as an off-gas. In specific embodiments, the process conditions (e.g., temperature, mixing speed, rate of addition of reactants) are selected to reduce the formation of toxic off-gases, minimize the thermal decomposition of the oxidant and promote the recovery of the radioactive compounds from the concentrated phosphoric acid reaction medium. While not wanting to be bound by any theory, it is believed that the use of phosphoric acid in the context of the described methods suppresses unstable and explosive nitrate compounds, thus allowing the safe recovery of radionuclides from the waste mixture. Selective recovery of radionuclides is effectively carried out, for example, by adjusting various reaction parameters such as temperature and oxidation potential of the reaction mixtures.

Although any concentration of phosphoric acid can be used, superphosphoric acid (SPA) is used in specific embodiments because this polymerized acid is both a good solvent and an effective catalyst. SPA remains fluid and non-volatile at temperatures at or below 650° F. and can catalyze a wide variety of chemical reactions, including the pyrolysis or thermal decomposition of organic compounds and the hydrolysis of organic compounds under reducing conditions. SPA typically contains 68% to 72% phosphoric acid as $P_2O_5$, which is equivalent to 100% $H_3PO_4$ plus varying amounts of polyphosphate. The pyrophosphates and polyphosphates in SPA are known to be excellent chelating agents for metals, and phosphate salts are reported to have a high affinity for selected radioactive metals including uranium and neptunium, allowing these metals to remain captured in the acidic media during oxidation reactions that promote the conversion of organic compounds into carbon dioxide and water.

In some embodiments, mixed radioactive organic waste is continually added to phosphoric acid (such as SPA) which is maintained at a temperature above about 250° F., including temperatures between about 300° F. and 400° F. Heating the waste with phosphoric acid causes the radioactive metals and their salts to concentrate in the acidic media. When the concentration of the radionuclides in acidic media reaches a value of about 5-10% by weight, the radionuclides typically precipitate out of the mixture.

In some embodiments, the waste comprises a sufficient amount of a sufficiently strong oxidant such that the method can be carried out without adding additional oxidant. In other embodiments, an oxidant is added.

Examples of suitable oxidants include a wide variety of strong oxidizing agents such as nitric acid, ammonium nitrate, iodate, chromate, permanganate, peroxide, oxygen, ozone, persulfate, sodium chlorate, perchlorate, sodium or ammonium peroxydisulphate, and air. Iodate, peroxide, chromate, permanganate, and peroxydisulphate are effective oxidants, but their cost limits their commercial use. Oxidants such as chromate, permanganate, chlorate, perchlorate and iodate may be less desirable because they may leave toxic by-products in the acid medium. Oxygen, ozone and air also can be used as oxidants, although they may be less desirable commercially unless a pressurized corrosion-resistant reactor is available.

In specific embodiments, the oxidant is ammonium nitrate or nitric acid. In one specific embodiment, ammonium nitrate is the oxidant. Ammonium nitrate may be advantageous because it forms less foam than other oxidants and does not produce high concentrations of toxic nitrogen dioxide or nitrogen oxide in the off-gas. Additionally, actinides will react with ammonium nitrate to form insoluble metallic ammonium phosphate precipitates that can be selectively recovered from the reaction mixture, as discussed in more detail below.

The oxidant can be added to the phosphoric acid/organic radioactive waste mixture prior to heating the mixture or the oxidant can be added to the mixture after the mixture has attained the desired temperature. In some embodiments, the reaction mixture is heated to a desired temperature above about 250° F., including a desired temperature between about 300° F. and 400° F. In some embodiments, the reaction mixture is heated by an external source. In some embodiments the reaction mixture is heated by an exothermic reaction between compounds present in the radioactive organic waste stream. In some embodiments, the reaction mixture is heated by both an external source and exothermic reaction.

In some embodiments, an excess of oxidant is used to facilitate complete oxidation of the organic compounds. In some embodiments the amount of oxidant is sufficient to oxidize the organic compounds to $CO_2$ and water, such that radionuclides can be separated from the organic compounds. For example, in the case of ammonium nitrate, the ratio of oxidant to carbon material in the waste may be 2:1, including 5:1, 6:1, 7:1, 8:1, 9:1 and 10:1, all on a wt/wt basis. Typically, about 2-10 pounds of ammonium nitrate are added for each pound of carbon in the waste stream. In some embodiments, sufficient oxidant is used to raise the EMF of the reaction mixture to about 700 mv, or about 800 mv, or to raise the EMF by at least about 300 mv relative to the EMF of the mixed waste feed. (U.S. Pat. No. 6,911,191 describes methods of measuring EMF while oxidizing organic compounds in phosphoric acid.) In some embodiments, the oxidation step reduces the carbon concentration in the waste/phosphoric acid mixture to a level below about 500 ppm.

Excess oxidant facilitates oxidation of the radionuclides in the reaction mixture to their highest oxidation states, converting, for example, uranium (IV) into uranium (VI), plutonium (III) into plutonium (IV) and neptunium (IV) and (V) into neptunium (VI). Moreover, oxidation enhances the recovery of radionuclides by allowing the higher oxidation state radionuclides to remain in solution during the oxidation and volatilization of the organic compounds present in the liquid waste mixture.

In some embodiments, it may be desirable to heat the phosphoric acid/organic radioactive waste mixture before the oxidation step under reducing conditions in the absence of an oxidant to volatilize organic compounds and/or pyrolize stable organic compounds that may be present in the reaction mixture. Typical temperatures for this step may be greater than about 350° F., including between about 400 and 500° F. Volatile organic compounds (which may be valuable) can be recovered from the resulting off-gas and the remaining pyrolyzed compounds may be more susceptible to oxidation. For example, chlorinated solvents that are resistant to oxidation, such as trichloroethylene, can be pyrolyzed into more easily oxidized compounds, resulting in the need for less oxidant during the oxidation step. Thus, the order of the addition of the oxidant can be varied depending on the composition of the waste stream, to optimize the concentration of carbon dioxide and nitrogen and minimize the production of toxic compounds in the off-gas, while facilitating the recovery of useful products from the organic waste stream.

In some embodiments the method includes adding a reducing agent to the waste/phosphoric acid mixture, to form insoluble radioactive metal phosphate compounds, and separating the insoluble radioactive metal phosphate compounds, such as by filtration and/or centrifugation. The reducing agent may be added either as a solid, suspension or as a solution to the waster/phosphoric acid mixture. Non-limiting exemplars of reducing agents include powdered metallic iron, zinc or aluminum, including reduced iron or ferrous iron. Alternatively, ammonia, formic acid, hydrazine or hydrogen gas, can be used as reducing agents. For example, plutonium can be selectively precipitated from a waste mixture containing uranium by adding either ammonia, formic acid, hydrazine or hydrogen gas to the acidic reaction mixture. Selective precipitation of plutonium occurs because plutonium (IV) is reduced to plutonium (III) which is insoluble in SPA and forms a precipitate. In contrast, uranium remains in solution because of its greater solubility in SPA.

The amount of reducing agent used typically will depend on the nature of the reducing agent and the composition of the radionuclides in the mixture. Inorganic reducing agents such as reduced iron and ferrous iron are typically added to the hot mixture (e.g., having a temperature between about 350° F. and 400° F.). In embodiments using iron as the reducing agent, iron may be added to the waste mixture as a solid powder, or as a suspension or solution. In some embodiments, sufficient reducing agent is added to lower the EMF of the mixture to about 450 mv, in order to reduce the radionuclides to their lowest oxidation state.

In some embodiments, the method includes, after the oxidation step and, optionally, before the reducing step discussed above, adding water to the waste/phosphoric acid mixture to hydrolyze any polyphosphate that may be present. In specific embodiments, the water is added in an amount sufficient to reduce the concentration of phosphoric acid in the mixture to about 54% to 60%. (As noted above, SPA typically contains 68% to 72% phosphoric acid.) This step may facilitate the selective precipitation of plutonium (III) and (IV). In the absence of polyphosphate and under reducing conditions (e.g., in the absence of oxidant), both plutonium (III) and (IV) will have a much greater tendency to form insoluble precipitates as compared to uranium (IV) or uranium (VI).

In some embodiments, a fluorine compound, such as hydrofluoric acid, sodium fluoride or $H_2SiF_6$, is added to the waste/phosphoric acid mixture to encourage the formation of uranium hexafluoride, which is removed, for example, as an off-gas. For example, at temperatures above about 300° F., uranium hexafluoride vaporizes along with water vapor and any excess $H_2SiF_6$. These compounds can then be recovered by condensing the off-gas. This step allows the selective removal of uranium from other radionuclides that do not form volatile fluorine complexes.

In some embodiments, the method includes, after the reducing step, aging the waste/phosphoric acid mixture to facilitate the selective formation of insoluble radioactive metal phosphate compounds, which can readily be separated at different time points. For example, the least soluble radioactive metal phosphate compounds can be separated first, followed by the next least soluble radioactive metal phosphate compounds, and the process repeated. The temperature can be varied (e.g., lowered) to encourage precipitation of insoluble radioactive metal phosphate compounds.

In some embodiments, after the desired degree of separation is attained for one or more radionuclides (or salts thereof), ammonia is added to the waste/phosphoric acid mixture to neutralize phosphoric acid and form an ammonium phosphate liquor. With this step, radionuclides remaining in the acidic mixture are converted into ammonium phosphate complexes comprising the radionuclides. These complexes may precipitate out of the ammonium polyphosphate liquor by gravity settling or can be separated by suitable separation techniques, such as filtration or centrifugation.

In some embodiments, the method includes, after the ammonia step, aging the waste/phosphoric acid mixture to facilitate the formation of insoluble ammonium phosphate complexes comprising the radionuclides, which can readily be separated at different time points. The temperature can be varied (e.g., lowered) to encourage precipitation of insoluble complexes.

As noted above, after separation, the ammonium phosphate complexes can be further purified and reused. Additionally or alternatively, the ammonium polyphosphate liquor can be converted into liquid fertilizer.

Liquid radioactive organic waste obtained from nuclear fuel processing plants typically has a high concentration of actinides, and treatment of such waste typically involves the use of strong oxidants (such as nitric acid) to dissolve the actinides in the waste. For example, spent fuel may be dissolved in nitric acid and the dissolved uranium and plutonium subsequently extracted from the nitric acid solution into an organic phase of tributyl phosphate (TBP) and an inert hydrocarbon such as odorless kerosene. Thus, as noted above, mixed radioactive waste to be treated by the present methods may contain sufficient nitric acid (or another strong acid) for the oxidation step without the addition of further oxidant. Moreover, as noted above, because the oxidation of organic compounds in the waste by a strong chemical oxidant is exothermic, the oxidation reaction may generate sufficient heat so that heat does not always need to be provided by an external source in order to reach the desired temperature.

As discussed above, the steps used in a given treatment process may vary depending on the composition of the radioactive organic waste being treated. For example, waste containing only uranium and hydrocarbon solvent may not require a heating/pyrolysis step, a reduction step, or extensive aging. The skilled artisan guided by the teachings herein will be able to select suitable steps for treating a given composition of radioactive organic waste.

The methods described herein can be carried out as a series of sequential steps in a single vessel, either in batch or continuous processing mode, or in a series of vessels. Commercial reactors can be designed to operate in batch-mode, or in continuous mode using a continuously stirred tank reactor (CSTR). A continuously stirred tank reactor may be advantageous when the composition of the mixed radioactive organic waste feed is to undergo pyrolysis prior to oxidation.

FIG. 1 provides a schematic flow chart of a process and equipment (100) that can be used in batch-mode for the method described in Example 1. The equipment basically consists of a reaction flask (110) containing radioactive waste material and equipped with a stirrer and heat source (120); sources of $H_2SiF_6$ (130), ammonium nitrate (140), and reductant (190); apparatuses for sampling and/or collecting the gases (150, 155) and liquids (160) evolved during the process; a source of anhydrous ammonia (170); a pipe reactor (180) for the anhydrous ammonia reaction, and a vessel (185) to collect the ammonium polyphosphate liquor from the pipe reactor. It should be understood that the invention includes methods that omit one or more of the steps that can be carried out by the equipment illustrated in FIG. 1, or methods that include additional steps.

Figure 2A:
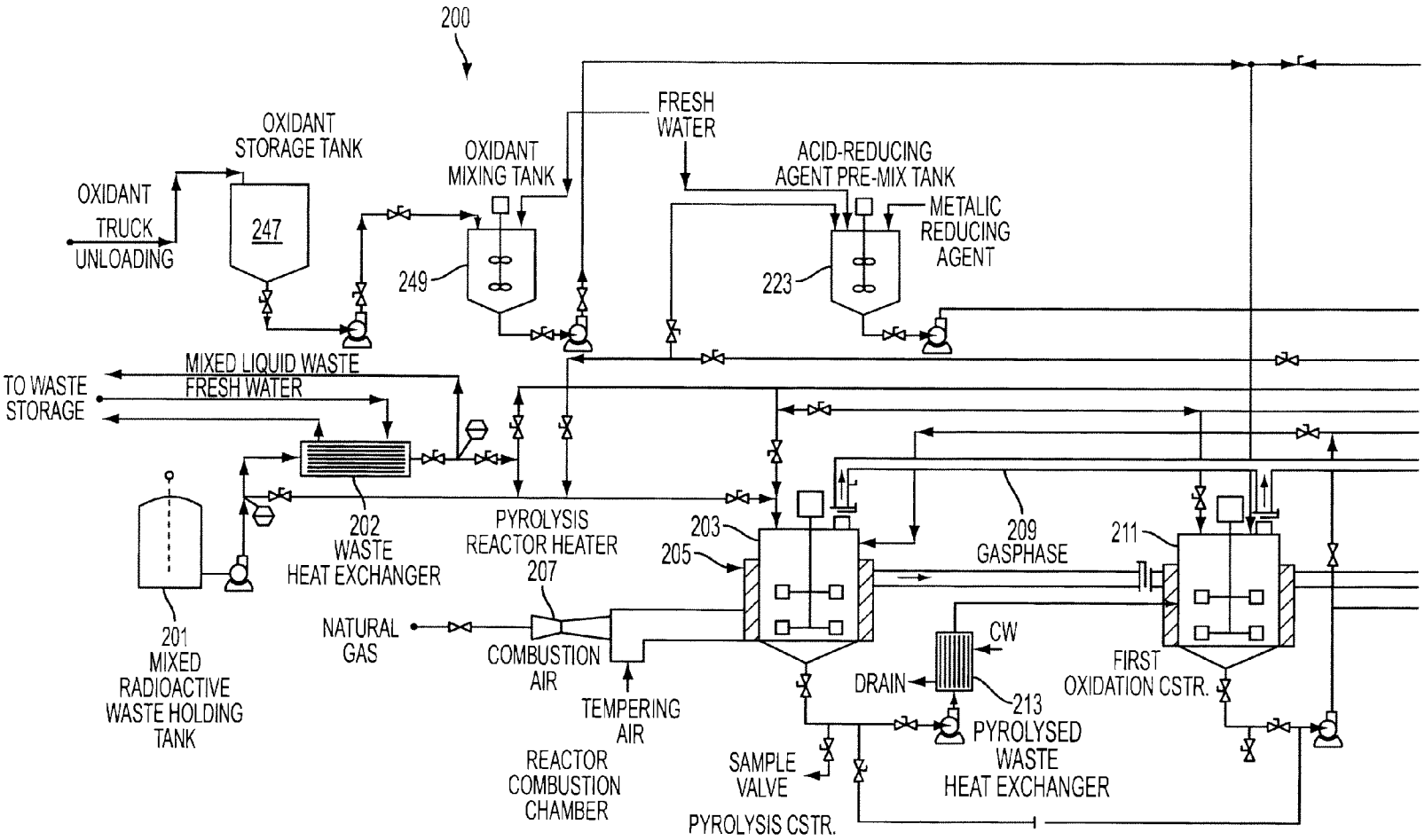
FIG. 2 (presented in three parts as FIGS. 2A, 2B and 2C) provides a schematic flow chart for an exemplary commercial waste treatment plant designed to process mixed radioactive organic waste in accordance with the methods described herein.
Figure 2B:
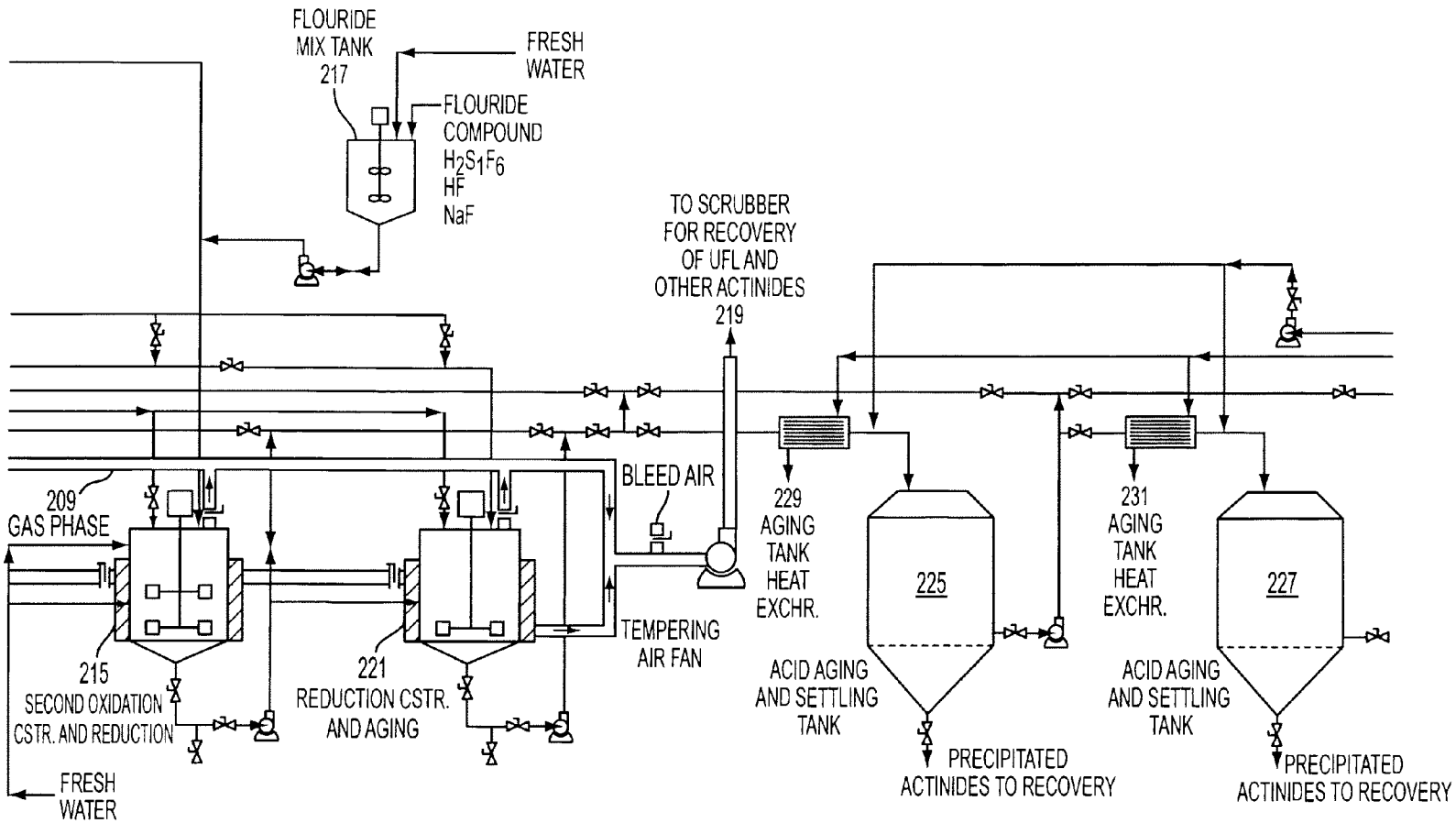
Figure 2C:
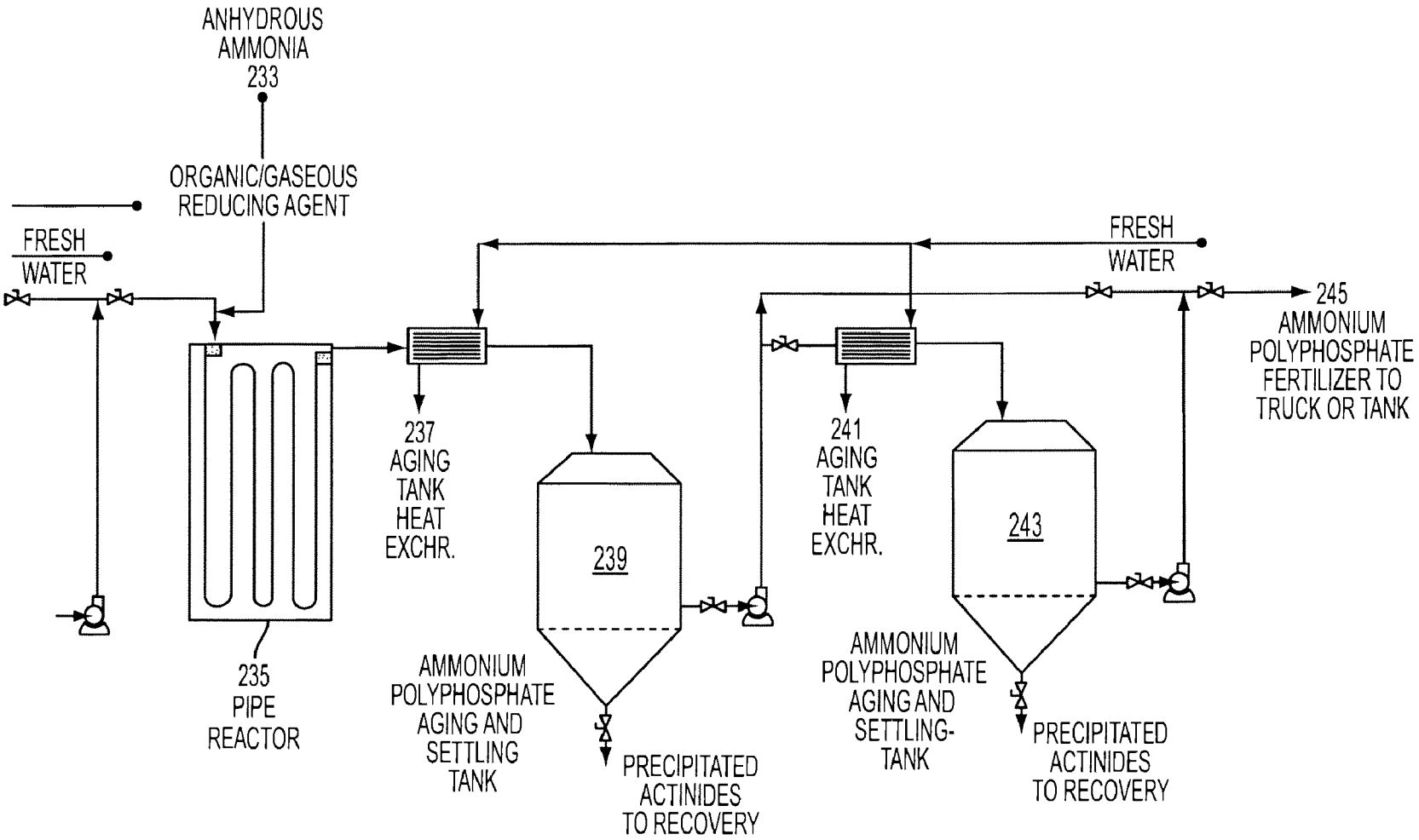

FIG. 2 illustrates a schematic flow chart for an exemplary commercial waste treatment plant (200) designed to process mixed radioactive organic wastes of varying compositions in accordance with the methods described herein. It should be understood that the invention includes methods that omit one or more of the steps illustrated in FIG. 2, or methods that include additional steps.

The first step shown involves charging a vented stirred tank reactor (203) (the primary reactor) with a 66%-72% solution of SPA. The radioactive organic waste feed may be fed directly from a waste storage site or directed from a storage tank (201) into the primary reactor (203) through a feed line whose outlet is below the surface of the SPA in the reactor at approximately the same depth as the impeller. Optionally, the waste may be passed through a heat exchanger (202) to reduce its temperature. In embodiments including a heating (pyrolysis) step (a'), the step may be conducted in primary reactor via the use of a pyrolysis jacket (205). A gas-fired heater (207) may be coupled to the reactor for heating and maintaining the reaction mixture at the desired temperature. The reactor may be equipped with a high-speed turbine and static mixing baffles (not shown). The gases produced in the reactor can exit via an overhead off-gas line (209). Pyrolyzed mixed waste can be transferred from the pyrolysis reactor to the primary oxidation reactor (211). In specific embodiments that do not involve pyrolysis of the waste prior to oxidation, oxidant from storage tank (247) is optionally mixed in a mixing tank (249) and then introduced into the primary oxidation reactor (211). In some embodiments, the waste/SPA mixture is combined with one or more reducing agents in an acid-reducing agent pre-mix tank (223) followed by heating the mixture to remove volatile organic compounds. In some embodiments, water may be introduced into the oxidant mixing tank (249). In other embodiments, water may be introduced into the acid-reducing agent pre-mix tank (223). In some embodiments, the reducing agent is present as a solid or in powder form or as a suspension or solution in the reducing agent pre-mix tank (223).

As shown in FIG. 2, the waste/SPA mixture obtained from the pyrolysis reactor, or, if no preliminary heating/pyrolysis step is used, the mixed radioactive organic waste from a storage tank, is transferred to a jacketed and vented stirred primary oxidation tank reactor (211). If this is the first step, a solution of 66%-72% SPA is charged to the reactor prior to transfer. Similar to the pyrolysis reactor, the primary oxidation reactor can also function in the batch mode or in a continuous mode using a continuously stirred tank reactor (CSTR). Hot gas from a gas-fired heater may be used to heat the contents of the oxidation reactor, or a heat exchanger (213) may be use to cool the contents of the feed from the pyrolysis reactor. The oxidant (such as $NH_4NO_3$) can be directly added to the reactor tank or can be premixed with the SPA feed using an in-line mixing tee prior to introduction into the reactor tank. The reactor also may be equipped with a high-speed turbine and static mixing baffles (not shown), as well as an off-gas line (209) to allow the gaseous overhead in the unit to exit the reactor.

The oxidation reactor is designed to maintain the reaction mixture at the optimum temperature, while providing vigorous mixing of the reactants. As discussed above, in some embodiments, the weight ratio of oxidant to incoming SPA feed is controlled so as to maintain the EMF of the reaction mixture above about 700 mv, such as about 800 mv, relative to the incoming mixed waste feed. Additionally, the weight ratio of oxidant to incoming SPA feed can be controlled to control the combined concentration of NO and $NO_2$ in the overhead gases from the primary oxidation reactor at a level below about 1.0 weight percent, including at below about 0.10 weight percent.

As discussed above, in some embodiments, the temperature of the mixture in the primary oxidation reactor is maintained in a range from greater than about 250° F. to about 400° F. In some embodiments, the desired temperature ranges from between about 300° F. and about 350° F. The present inventors have found that efficiency of the oxidation reaction is reduced at temperatures below about 250° F. However, if the temperature of the reaction mixture is above about 350° F., decomposition of the oxidant may be favored over its reaction with the organic compounds in the mixture. Minimizing sudden temperature changes of the reaction mixture may be particularly important when ammonium nitrate is used as the oxidant due to the exothermic nature of its interaction with the organic compounds in the mixture.

Vigorous mixing of the reaction mixture in the primary oxidation reactor may help ensure intimate contact between the oxidant and the components of the mixture and thus may influence the rate of addition of ammonium nitrate as well as the residence time of the reaction mixture during the oxidation stage of both the batch and continuous treatment processes. In one embodiment, adequate mixing is provided to maintain highly turbulent conditions within the reaction mixture. Typical residence times for the reaction mixture during the oxidation stage of a continuous process using a primary CSTR and under optimum mixing conditions, may be, for example, between about 15 and 90 minutes, including about 60 minutes, but may be longer depending on the composition of the feed.

In some embodiments, the rate of addition of ammonium nitrate is controlled to minimize the generation of NO and $NO_2$ while maximizing the generation of $N_2$ during the oxidation process. For a reactor operating in the batch mode, complete addition of the required amount of ammonium nitrate may be achieved in a time interval of about 15 to 120 minutes. Rapid addition of ammonium nitrate may promote foaming and decrease oxidation efficiency because of decomposition of ammonium nitrate into $NO_2$ and other by-products. This may result in an increase in the amount of oxidant necessary for complete oxidation and/or an unacceptable increase in the levels of $NO_2$ in the overhead gas stream.

The oxidized waste/SPA mixture may be transferred from the primary oxidation reactor (211) to a secondary oxidation/reduction reactor (215). As discussed above, in some embodiments, the oxidized waste/SPA mixture entering the secondary oxidation/reduction reactor has an EMF about 800 mv. The primary purpose of the secondary oxidation/reduction reactor is to provide additional residence time for oxidation of the radionuclides and to allow the addition of a fluorine compound when uranium is believed to be present. As discussed above, excess $H_2SiF$ or another suitable fluorine compound may be added from a fluorine mix/storage tank (217) to form uranium hexafluoride, and the mixture may be heated to a temperature above about 300° F. to volatilize the uranium hexafluoride so that it can be separated from the remaining mixture. In some embodiments, water is introduced into the fluorine mix tank. The volatilized uranium hexafluoride can be condensed from the off-gas stream (209) and captured for reuse (219). The type of fluorine compound used may depend on the composition of the radioactive waste mixture. In some embodiments a mixture of fluorine compounds are used which can be premixed in a fluoride mix tank (217) prior to introduction into the secondary oxidation/reduction reactor (215). In some embodiments, water is added to the oxidized waste/SPA mixture in the secondary oxidation/reduction tank (215), for example, to hydrolyze polyphosphate that may be present and reduce the concentration of phosphoric acid in the reaction mixture to about 54% to 60% by weight.

The oxidized waste/SPA mixture may be transferred from the secondary oxidation reactor to a reduction reactor (221). A suitable reducing agent is added to the oxidized waste/SPA mixture in the reduction reactor (221) to facilitate the formation of insoluble radioactive metal phosphate compounds.

The reducing agent may be added as a solid, in powder form, as a suspension, or as a solution. As discussed above, the amount of reducing agent added typically depends upon the nature of the reducing agent and the composition of the radionuclides in the mixture. The reduced waste/SPA mixture may then be transferred from the reduction reactor to the first of two aging and settling tanks (225). In some embodiments, the reduced waste/SPA mixture is passed through a heat exchanger (229) prior to being transferred to the first aging/settling tank in order to lower the temperature of the mixture. This may be particularly advantageous when the composition of the waste is such that a lower temperature of the reaction mixture facilitates the precipitation of selected actinides. The reduced waste/SPA mixture is allowed to age in the aging/settling tank until the selected actinide falls out of solution in the form of an insoluble radioactive metal phosphate compound. Alternatively, if a reducing agent that decomposes or degases at the temperatures used in the reduction reactor is to be used, that reducing agent can be added to the waste/SPA mixture after its transfer to one of the aging/settling tanks, where it may promote the formation of an insoluble radioactive metal phosphate compound.

After the desired degree of precipitation of selected insoluble radioactive metal phosphate compounds is attained in the first aging/settling tank, the resultant waste/SPA mixture can be separated from the precipitate by transferring the mixture, optionally through a heat exchanger (231), to a second aging/settling tank (227). (This step can be repeated additional times, as may be warranted by the mixture being treated.) Passage of the mixture through a heat exchanger lowers the temperature of the mixture and facilitates the formation of additional insoluble radioactive metal phosphate compounds. The mixture may be allowed to age until the desired degree of precipitation of additional selected insoluble radioactive metal phosphate compounds is attained.

The waste/SPA mixture may then be combined with anhydrous ammonia (233) to form ammonium phosphate complexes containing radionuclides that do not readily form insoluble precipitates in SPA by the preceding steps. As illustrated in FIG. 2, anhydrous ammonia is combined with the waste/SPA mixture and passed through a pipe reactor (235), forming an ammonium polyphosphate liquor. The liquor is then transferred, optionally through a heat exchanger (237), into the first of two ammonium polyphosphate liquor aging/settling tanks (239). Here, the pH of the mixture is neutralized or rendered slightly basic to promote the formation of insoluble radionuclide-ammonium phosphate complexes that can be separated from the liquor by filtration or centrifugation. (Passage of the mixture through a heat exchanger lowers the temperature of the mixture after the exothermic reaction between the SPA and ammonia.) The liquor is allowed to age in the tank for a time interval that is sufficient to precipitate the complexes and allow the resultant solids to settle out of solution.

After the desired amount of separation is achieved, the mixture may be transferred, optionally through a heat exchanger (241), to a second aging/settling tank (243). (This step can be repeated additional times, as may be warranted by the mixture being treated.) Passage of the mixture through a heat exchanger lowers the temperature of the mixture and facilitates the formation of additional insoluble radionuclide-ammonium phosphate complexes that can be separated from the liquor by filtration or centrifugation. The resulting ammonium phosphate liquor can be further processed, such as for use as liquid fertilizer, and transferred to a truck or tank (245).

The processes illustrated in FIGS. 1 and 2 and the foregoing description of the invention are intended to encompass either continuous or batch-mode operations. It should be understood that the primary and secondary stages of the batch-mode treatment process could be carried out in either a single tank or in two tanks, or in both tanks sequentially, or in series.

The following non-limiting examples are intended to illustrate the use and benefits of the treatment process when used to treat various mixed radioactive organic wastes.

EXAMPLE 1

A schematic diagram (100) of the equipment that can be used in batch-mode for the treatment process as described herein is shown in FIG. 1. The equipment basically consists of a reaction flask (110) equipped with stirring motor and heating mantle (120), a pump for delivery of ammonium nitrate from a reservoir (140), apparatuses for sampling and collecting the gases (150, 155) and liquids (160) evolved during the process, a pipe reactor (180), a pump for delivery of decarbonized and oxidized mixed waste/SPA to the pipe reactor, a pressurized tank of anhydrous ammonia (170), and a pipe and valve to deliver the gas to the pipe reactor and a collection vessel (185) to collect the ammonium phosphate liquor from the pipe reactor.

A typical radioactive organic waste may include organic compounds, transition metals and actinides, such as dissolved metals including about 200 ppm uranium, about 500 ppm iron, about 300 ppm magnesium, about 250 ppm aluminum; about 3,000 ppm (as carbon) organic compounds including humic acids, keratins, carbon floc.

Such waste is added with 68% SPA to an airtight round-bottom flask (110) and heated to above 350° F. The heated space above the reactor and the gas sampling and collection apparatus are then evacuated and purged with helium. Helium is continuously flushed through the reactor at approximately 300 ml/min to remove the by-product gases from the reactor and provide for instantaneous sampling of the by-product gases produced during the reaction throughout the treatment process. A 60% solution of ammonium nitrate (140) is pumped at a constant flow rate of 0.02 weight percent/minute into the vigorously stirring reaction mixture, and the temperature of the mixture is maintained between about 350° F. and 400° F. Ammonium nitrate is added to the reactor over a 90-minute interval, and gas and liquid samples are taken from the reactor every ten minutes. The reaction mixture is then allowed to age for an additional 120 minutes without addition of any more ammonium nitrate and until the concentration of the organic compounds is found to be about 600 ppm (as carbon) and the EMF of the reaction mixture is found to be above about 700 mv. Powdered iron reductant is then added to the acidic mixture to reduce the EMF of the mixture to about 450 mv and the mixture is allowed to age for several days until a precipitate forms at the bottom of the flask. The precipitate is shown to contain uranium, iron, magnesium and aluminum. The aged mixture is then reacted with anhydrous ammonia (170) in a pipe reactor (180) to form ammonium polyphosphate liquor and the resultant liquor is collected (185) and allowed to age for several days in order to facilitate the formation of a precipitate. Analysis of the resultant precipitate indicates the presence of uranium, while no uranium is detected in the ammonium polyphosphate liquor. $N_2$ and $CO_2$ are the most abundant species gaseous by-products produced based on an analysis of the off-gas.

EXAMPLE 2

Referring to FIG. 1, red oil mixed waste consisting of tributylphosphate (TBP), kerosene, water, nitric acid at a concentration greater than 10M, uranyl nitrate, plutonium nitrate, thorium nitrate and fission product nitrate salting agents is slowly added to 68% SPA that has already been charged to the airtight round-bottom flask (110). The red oil is added below the surface of the SPA at a rate of 1 part red oil to 1,000 parts SPA and the mixture is heated to above 250° F. The heated space above the reactor and the gas sampling and collection apparatus are then evacuated and purged with helium. Helium is continuously flushed through the reactor at approximately 300 ml/min. to remove the by-product gases from the reactor and provide for instantaneous sampling of the by-product gases produced during the reaction throughout the treatment process.

The high concentration of nitric acid, about 10M in the waste, may be sufficient to partially or wholly oxidize the TBP and decompose actinide nitrate compounds present in the waste. However, a 60% ammonium nitrate solution (140) is added to the reaction to ensure complete oxidation of the organic compounds and any uranium that is present as uranium (VI). The added ammonium nitrate also helps to maintain an EMF above about 700 mv in the reaction mixture. Red oil waste is continually added to the mixture until the actinide concentration is between about 5 and 10% in the mixture. The reaction mixture is then allowed to age for an additional time period of about 120 minutes without any further addition of ammonium nitrate and the temperature of the mixture is raised to above 300° F.

A solution of $H_2SiF$ (130) is then added to the mixture and allowed to react with uranium (VI) to form uranium hexafluoride. The uranium hexafluoride vaporizes on heating along with other fluoride compounds and water and is collected in the gas bag (155) after cooling to an ambient temperature. Powdered iron reductant is added to the mixture to reduce the EMF of the mixture to about 450 mv and the mixture is allowed to age for several days until a precipitate forms at the bottom of the flask. The precipitate is shown to contain plutonium and thorium. The aged mixture is then reacted with anhydrous ammonia (170) in a pipe reactor (180) to form ammonium polyphosphate liquor and the resultant liquor is collected (185) and allowed to age for several days in order to facilitate the formation of precipitates of plutonium and thorium. NOx, $N_2$ and $CO_2$ are the most abundant gaseous species produced and vented.

It will be apparent to those skilled in the art that various modifications and variations can be made in the practice of the present invention without departing from the scope or spirit of the invention. Other embodiments of the invention will be apparent to those skilled in the art from consideration of the specification and practice of the invention. It is intended that the specification and examples be considered as exemplary only, with the true scope and spirit of the invention being indicated by the claims.

What is claimed is:

1. A method of treating a radioactive organic waste stream comprising:

(a) mixing a radioactive organic waste stream comprising organic compounds and radionuclides with superphosphoric acid (SPA) to form a reaction mixture;

(b) heating the reaction mixture to a desired temperature in the presence of an oxidant to oxidize organic compounds present in the waste stream, and removing oxidized organic compounds from the reaction mixture;

(c) optionally, adding a reducing agent to the reaction mixture to form insoluble radioactive metal phosphate compounds comprising one or more of the radionuclides, and separating the insoluble radioactive metal phosphate compounds from the reaction mixture;

(d) optionally, adding a fluorine compound to the reaction mixture to react with uranium that may be present in the reaction mixture to form uranium hexafluoride, and removing uranium hexafluoride from the reaction mixture;

(e) adding ammonia to the reaction mixture to neutralize phosphoric acid and to form ammonium phosphate complexes comprising one or more of the radionuclides, and separating the ammonium phosphate complexes from the reaction mixture to yield an ammonium phosphate liquor, wherein the method includes performing at least one of steps (c) and (d).

2. The method of claim 1, wherein the method is carried out in a batch mode or in a continuous mode.

3. The method of claim 1, wherein the radioactive organic waste stream comprises one or more radionuclides selected from the group consisting of plutonium, uranium, neptunium.

4. The method of claim 1, wherein the oxidant is added to the reaction mixture.

5. The method of claim 4, wherein the oxidant is selected from the group consisting of nitric acid; ammonium nitrate; iodate; chromate; permanganate; peroxide; oxygen; ozone; persulfate; sodium chlorate sodium perchlorate; sodium peroxydisulphate; ammonium peroxydisulphate; air; iodate; peroxide; chromate; permanganate; peroxydisulphate; chlorate; and perchlorate.

6. The method of claim 1, wherein the amount of oxidant in the reaction mixture in step (b) is sufficient to oxidize organic compounds that may remain in the reaction mixture to $CO_2$ and water, thereby permitting separation of the organic compounds from the radionuclides.

7. The method of claim 5, wherein the oxidant is ammonium nitrate and is present in an amount of about 2-10 pounds ammonium nitrate per pound of carbon in the radioactive organic waste stream.

8. The method of claim 1, wherein, in step (b), the reaction mixture is heated to a temperature above 250° F.

9. The method of claim 1, wherein, in step (b), the reaction mixture is heated by an external source.

10. The method of claim 1, wherein, in step (b), the reaction mixture is heated by an exothermic reaction between compounds present in the radioactive organic waste stream.

11. The method of claim 1, wherein the reducing agent is selected from the group consisting of iron, zinc aluminum, ammonia, formic acid, hydrazine and hydrogen gas.

12. The method of claim 1, wherein the fluorine compound is selected from the group consisting of hydrofluoric acid, sodium fluoride and $H_2SiF_6$.

13. The method of claim 1, wherein, in step (c), the insoluble radioactive metal phosphate compounds are separated from the reaction mixture by a method comprising one or more of filtration and centrifugation.

14. The method of claim 1, wherein, in step (d), the uranium hexafluoride is removed from the reaction mixture as an off-gas.

15. The method of claim 1, wherein, in step (e), the ammonium phosphate complexes are separated from the reaction mixture by a method comprising one or more of filtration and centrifugation.

16. The method of claim 1, wherein the method further comprises, prior to step (b):

(a') heating the reaction mixture to a temperature greater than 350° F. under reducing conditions in the absence of the oxidant to volatilize volatile organic compounds and pyrolize stable organic compounds that may be present in the reaction mixture, and removing volatilized organic compounds from the reaction mixture as an off-gas.

17. The method of claim 1, wherein the method further comprises, after step (b):

(b') adding water to the reaction mixture to hydrolyze polyphosphate that may be present in the mixture; wherein, in step (b'), water is added in an amount sufficient to achieve a phosphoric acid concentration in the reaction mixture of about 54% to 60% by weight.

18. The method of claim 1, wherein the method further comprises, after step (c):

(c') aging the reaction mixture to facilitate the formation of insoluble radioactive metal phosphate compounds.

19. The method of claim 1, wherein the separating step of step (c) is repeated at different time periods to separate insoluble radioactive metal phosphate compounds comprising different radionuclides at different time periods.

* * * * *